US005942055A

United States Patent [19]

Jackson et al.

[11] Patent Number: 5,942,055

[45] Date of Patent: Aug. 24, 1999

[54] SILICIDE COMPOSITE WITH NIOBIUM-BASED METALLIC PHASE AND SILICON-MODIFIED LAVES-TYPE PHASE

[75] Inventors: Melvin Robert Jackson; Bernard Patrick Bewlay, both of Niskayuna, N.Y.

[73] Assignee: General Electric Company, Schenectady, N.Y.

[21] Appl. No.: 09/131,609

[22] Filed: Aug. 10, 1998

[51] Int. Cl.[6] ..... C22C 27/02

[52] U.S. Cl. ..... 148/422; 148/442; 420/426; 420/588

[58] Field of Search ..... 420/425, 426, 420/578, 588; 48/422, 442

[56] References Cited

U.S. PATENT DOCUMENTS

| | | | |
|---|---|---|---|
| 4,762,557 | 8/1988 | Nagarajan et al. | 75/244 |
| 4,915,903 | 4/1990 | Brupbacher et al. | 420/129 |
| 5,640,666 | 6/1997 | Jayashanker et al. | 419/17 |
| 5,721,061 | 2/1998 | Jackson et al. | 428/641 |
| 5,741,376 | 4/1998 | Subramanian et al. | 148/422 |

OTHER PUBLICATIONS

Copending U.S. Patent application Ser. No. 08/498,826, filed Jul. 6, 1995, entitled "Nb–Base Alloys", Bewlay et al.

*Primary Examiner*—John Sheehan
*Attorney, Agent, or Firm*—Ernest G. Cusick; Noreen C. Johnson

[57] ABSTRACT

A silicide-based composite toughened with a niobium-based metallic phase and further containing a silicon-modified chromium-based Laves-type phase to promote oxidation resistance. The silicide-based composite generally contains one or more silicide intermetallic phases, each of which is an $M_5Si_3$-type or an $M_3Si$-type phase where M is at least Nb+Ti+Hf. The niobium-based metallic phase contains at least niobium, titanium, hafnium, chromium, aluminum and silicon. The silicon-modified Laves-type phase is of the $Cr_2M$ type where M is Nb+Ti+Hf. The silicide-based composite is formulated to contain greater than 25 volume percent of the niobium-based metallic phase, the balance being the silicide intermetallic phases and the silicon-modified Laves-type phase.

18 Claims, 6 Drawing Sheets

SILICIDE COMPOSITE WITH NIOBIUM-BASED METALLIC PHASE AND SILICON-MODIFIED LAVES-TYPE PHASE

This invention was made with Government support under Contract No. F33615-96-D-5835 awarded by the U.S. Department of the Air Force. The Government has certain rights in the invention.

FIELD OF THE INVENTION

The present invention relates to silicide-based composites toughened with a niobium-based metallic phase. More particularly, this invention relates to such a composite further containing a silicon-modified Laves-type phase that improves the oxidation resistance of the composite at elevated temperatures, wherein the amount of the silicide, metallic and Laves-type phases are balanced to promote the toughness of the composite.

BACKGROUND OF THE INVENTION

Various high temperature materials have been developed for use in gas turbine engines. Cobalt-base and nickel-base superalloys have found wide use in the manufacture of gas turbine engine components such as nozzles, combustors, and turbine vanes and blades. Other materials, including niobium-based alloys, have been considered for the high temperature regions of gas turbine engines, such as the exhaust section. For example, on the basis of promising acceptable levels of fracture toughness and creep resistance, silicide-based composites toughened with a niobium-based metallic phase (e.g., NbTiHfCrAlSi solid solution) have been investigated for applications where blade surface temperatures may exceed 1200 C. However, niobium and its alloys generally do not exhibit a sufficient level of oxidation resistance and creep performance at elevated temperatures. For this reason, niobium-containing materials intended for high temperature applications have typically required an oxidation-resistant coating, particularly if operating temperatures will exceed about 800 C. Commercially-available fusion coatings based on, in weight percent, Si-20Fe-20Cr have been proven effective in improving the oxidation resistance of niobium-base alloys. However, the fusion (reaction bonding) process must be conducted at about 1400 C., which can be detrimental to the alloy. In addition to the above, the Si-20Fe-20Cr alloy has not proven to be suitable as an oxidation-resistant coating for niobium-containing silicide-based composites.

It would be desirable if a silicide-based composite, and particularly one toughened with a niobium-based metallic phase, were available that exhibited improved oxidation resistance at temperatures of at least 1200 C., to enable such a material to be used in the hot section (turbine and exhaust) of a gas turbine engine without an oxidation-resistant coating. It would be further desirable if the niobium-based metallic phase were balanced with the intermetallic phases to provide a balance of high temperature strength and low temperature toughness.

SUMMARY OF THE INVENTION

According to the present invention, there is provided an oxidation-resistant silicide-based composite toughened with a niobium-based metallic phase and further containing an oxidation-resistant chromium-based Laves-type phase modified with silicon, in which the intermetallic silicide and Laves-type phases are balanced with the metallic phase to promote the toughness of the composite.

The oxidation-resistant silicide-based composites of this invention are NbTiHfCrAlSi composites that contain one or more silicide intermetallic phases, each of which is an $M_5Si_3$-type or an $M_3Si$-type phase where M is Nb+Ti+Hf. The niobium-based metallic phase contains niobium, titanium, hafnium, chromium, aluminum and silicon. The silicon-modified Laves-type phase is of the $Cr_2M$ type where M is Nb+Ti+Hf. Bulk composition ranges for the constituents are, in atomic percent, about 30 to 44% niobium, about 17 to 23% titanium, about 6 to about 9% hafnium, about 11 to 20% chromium, about 2 to 13% aluminum and about 13 to 18% silicon, with possible additions of boron, germanium, tantalum, tungsten, molybdenum, vanadium and zirconium. The composites contain about 30 to 50 volume percent of the silicide intermetallic, about 30 to 50 volume percent of the niobium-based metallic phase, and up to about 33 volume percent of the silicon-modified Laves-type phase.

According to the invention, the volume fraction of the niobium-based metallic phase in combination with the silicon-modified chromium-based Laves-type phase has been shown to produce a silicide-based composite having improved toughness while exhibiting a desirable level of oxidation resistance when subjected to conditions similar to that present in the hot section of a gas turbine engine.

Other advantages of this invention will be better appreciated from the following detailed description.

DETAILED DESCRIPTION OF THE INVENTION

Figure 2:
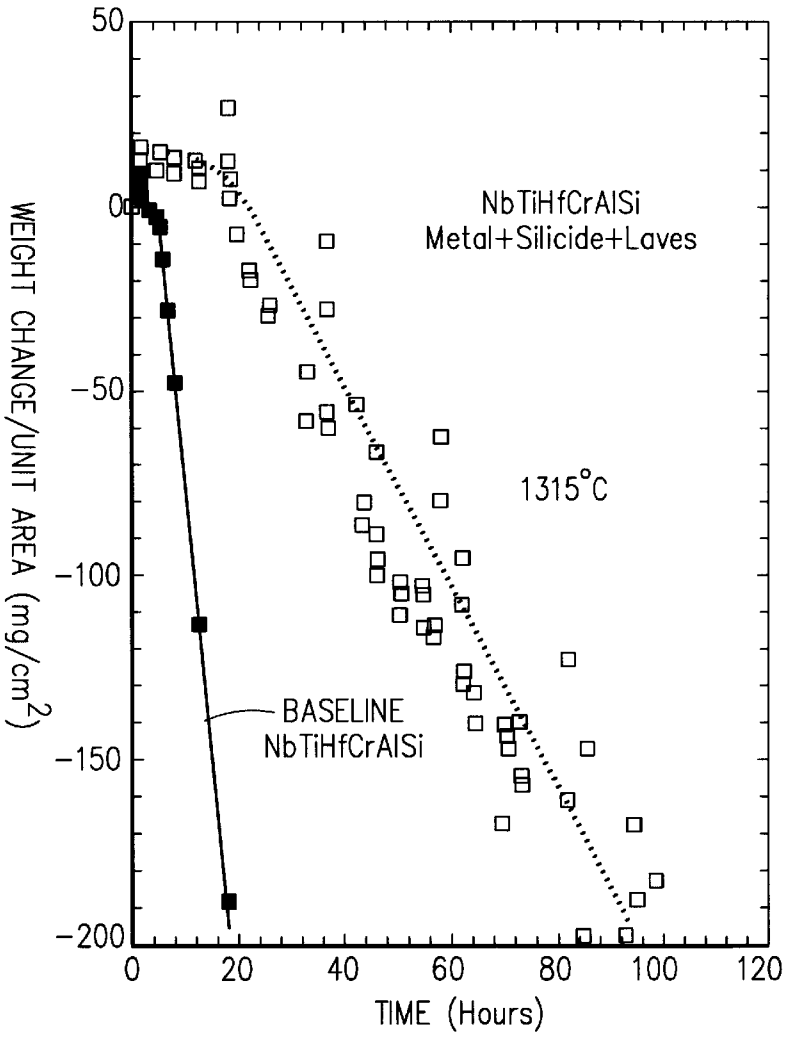
FIGS. 1 through 12 are graphs representing data that show improved oxidation resistance of silicide-based composites toughened with a niobium-based metallic phase and incorporating a silicon-modified Laves-type phase in accordance with this invention, as compared to a baseline NbTiHfCrAlSi composite without a silicon-modified Laves-type phase.

The present invention provides a family of NbTiHfCrAlSi composites that exhibit toughness and oxidation resistance at elevated temperatures of 1200 C. or more, so as to be a candidate material for the hot section components of a gas turbine engine. It is foreseeable that the composite of this invention could also be used to form other gas turbine engine components, including high and low pressure turbine nozzles and blades, shrouds, combustor liners and augmentor hardware. It is also within the scope of this invention that the composite could be used in numerous other applications in which a component is subjected to an oxidizing atmosphere at elevated temperatures.

The oxidation-resistant composite of this invention generally contains one or more silicide intermetallic phases, a niobium-based metallic toughening phase, and a silicon-modified Laves-type phase of the $Cr_2M$-type where M is Nb+Ti+Hf. As used herein, the terms "Laves-type" and "$Cr_2M$-type" designate a phase that resembles a $Cr_2M$ Laves phase, though the constituents of the phase are not necessarily present in the phase in stoichiometric amounts. The presence of the Laves-type phase is the result of the composite containing significantly higher bulk chromium concentrations than that employed by existing NbTiHfCrAlSi composite compositions. Oxidation-resistant $Cr_2M$ Laves phases where M is primarily Nb+Ti+Hf have been identified in the past. With this invention, a silicon-modified $Cr_2M$ Laves-type phase has been achieved whose presence in a niobium-containing silicide-based composite has been shown to dramatically improve the oxidation resistance of such composites.

In an investigation leading to this invention, a silicide-based composite was formulated to have a nominal composition, in atomic percent, of about 35% niobium, about 18% titanium, about 7% hafnium, about 20% chromium, about 2% aluminum and about 18% silicon. This composition differed from earlier NbTiHfCrAlSi composites by reason of its considerably higher chromium content (20% as compared to a more typical 2% content). The composite was produced by arc melting and casting in a water-cooled copper mold.

Phase identifications were conducted by electron microprobe quantitative chemical analysis, which showed the composite to contain several silicide intermetallic phases of the $M_5Si_3$-type and $M_3Si$-type where M is Nb+Ti+Hf, a niobium-based metallic phase, and the desired silicon-modified $Cr_2M$ Laves-type phase. One of the silicide intermetallic phases had a nominal composition, in atomic percent, of about 41.5% niobium, about 12% titanium, about 8.5% hafnium, about 1% chromium, about 2.5% aluminum and about 34.5% silicon, a second of the silicide intermetallic phases had a nominal composition, in atomic percent, of about 30.5% niobium, about 18.5% titanium, about 13.5% hafnium, about 1% chromium, about 2.5% aluminum and about 34% silicon, while the third silicide intermetallic phase had a nominal composition, in atomic percent, of about 22% niobium, about 27% titanium, about 13.5% hafnium, about 1% chromium, about 2.5% aluminum and about 34% silicon.

The niobium-based metallic phase was analyzed as having a nominal composition, in atomic percent, of about 57% niobium, about 27% titanium, about 2.5% hafnium, about 10% chromium, about 2.5% aluminum and about 1 % silicon. The silicon-modified Laves-type phase had a nominal composition, in atomic percent, of about 21 % niobium, about 11 % titanium, about 7% hafnium, about 51% chromium, about 2.5% aluminum and about 7.5% silicon. The silicide-based composite contained about 42 volume percent of the silicide intermetallic, about 25 volume percent of the niobium-based metallic phase, and about 33 volume percent of the silicon-modified Laves-type phase.

Pins approximately 0.26 inch (about 6.6 mm) in diameter with a length of about 0.565 inch (about 14.4 mm) were machined from the ingot by electrical discharge machining. Similarly sized pins were formed by essentially the same processes from a silicide-based composite having a nominal composition, in atomic percent, of about 46% niobium, about 26% titanium, about 8% hafnium, about 2% chromium, about 2% aluminum and about 16% silicon. Therefore, the second group of pins had a much lower chromium content than those of the first group (the "high-chromium" pins), and did not contain any significant amount of chromium-based Laves phase. The pins were then exposed isothermally at either about 1200 C. or about 1315 C., with periodic removal from the furnace for observation and measurement of weight change as a result of oxidation.

Figure 1:
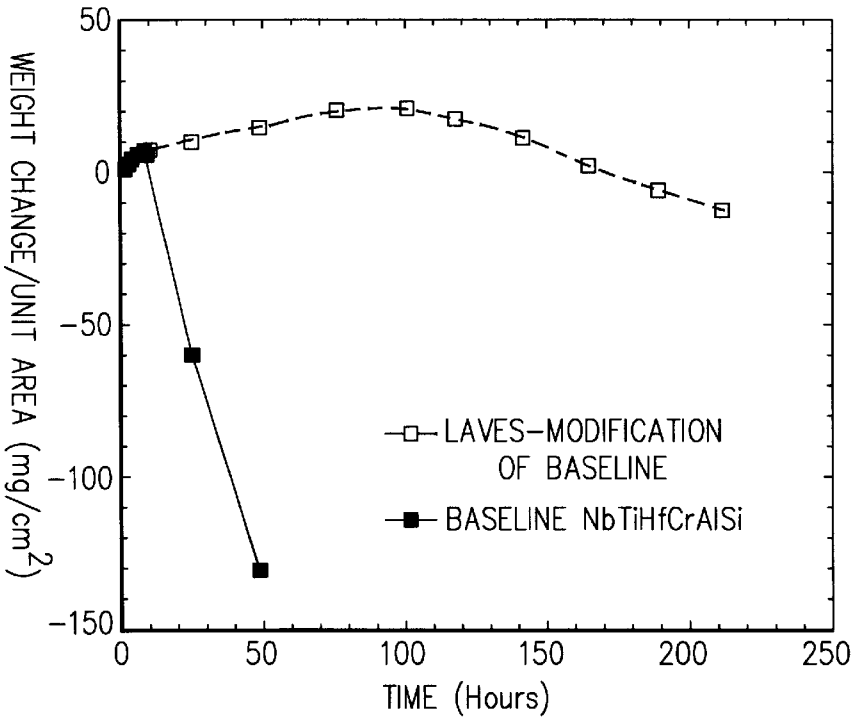

The results of the 1200 C. and 1315 C. tests are represented in FIGS. 1 and 2, respectively, which evidence that the oxidation resistance for the high-chromium pins whose composite compositions contained the silicon-modified Laves-type phase was dramatically superior to the pins with the lower chromium content. FIG. 1 reveals a gradual weight gain (attributable to oxidation) of about 20 milligrams per square centimeter of surface for the high-chromium pins, followed by a gradual weight loss. At two-hundred hours, these pins had lost about 10 mg/cm$^2$. In contrast, the pins formed of the low-chromium material exhibited an initial weight gain of about 10 mg/cm$^2$, followed by rapid weight loss of about 130 mg/cm$^2$ after only fifty test hours. FIG. 2 shows the high-chromium pins sustaining a weight loss of about 200 mg/cm$^2$ after about 100 hours, which compares extremely favorably to the same weight loss in only about 20 hours for the low-chromium pins.

On the basis of these tests, it was concluded that the presence of a silicon-modified chromium-based Laves-type phase has a significant effect on the oxidation resistance of a silicide-based composite toughened with a niobium-based metallic phase. An investigation into the effect of volume fractions above the 25 volume percent metallic phase achieved with the tested 35Nb-18Ti-7Hf-20Cr-2Al-18Si composite was then undertaken for the purpose of evaluating the effect on the toughness of the composite. During this investigation, the silicide-based composites identified in Table I were formulated. The general approach was to use reduced levels of chromium and silicon from those employed in the original tested composite. Alloys 1 and 2 were formulated to incrementally decrease the volume fraction of Laves-type phase while increasing the volume fraction of metallic phase relative to the tested silicide-based composite. Alloys 3 and 4 were formulated to maintain the volume fraction of the metallic phase attained in Alloy 2 while altering the volume fraction of the intermetallic phases. Alloys 5 and 6 contained an intermediate titanium concentration and Alloys 7 and 8 contained a high titanium concentration for the purpose of determining the effect that titanium has on the oxidation of the metallic and intermetallic phases. Alloys 9 through 19 were formulated using Alloy 3 as a base composition. Alloys 9 and 10 replaced 2Si, 1 Cr, 1 Nb and 1Ti with each addition of 5 atomic percent aluminum with the object of altering the oxidation kinetics of the metallic and intermetallic phases. Alloys 11 and 12 replaced 2Nb and 1Ti with each addition of 3 atomic percent boron with the intent that boron may occupy interstitial sites in the $M_5Si_3$ lattice and improve oxidation behavior by possibly changing kinetics of silica formation, affecting the viscosity of the oxide through glass-like formation, or providing additional atomic species for oxidation as a stable scale. On the basis that germanium can increase the expansion behavior of silica ($SiO_2$) to near-equality with that of niobium-base alloys, Alloys 13 and 14 replaced 2Si with each addition of 2 atomic percent germanium. Alloys 15 through 19 replaced 4Nb and 2Ti with additions of 6 atomic percent of either tantalum, tungsten, molybdenum, vanadium or zirconium for the purpose of determining whether these elements might serve to increase the strength of the metallic and intermetallic phases. Finally, as a comparison to Alloys 5 through 8, Alloy 20 was formulated to obtain an $M_5Si_3$ phase with a low titanium concentration.

TABLE I

| Alloy # | Nb | Ti | Hf | Cr | Si | Al | Other |
|---|---|---|---|---|---|---|---|
| 1 | 36.41 | 20.21 | 6.76 | 17.29 | 16.83 | 2.50 | — |
| 2 | 38.55 | 21.16 | 6.52 | 14.83 | 16.44 | 2.50 | — |
| 3 | 38.85 | 21.45 | 6.62 | 13.33 | 17.25 | 2.50 | — |
| 4 | 38.26 | 20.87 | 6.41 | 16.33 | 15.63 | 2.50 | — |
| 5 | 33.84 | 18.00 | 8.69 | 19.75 | 17.22 | 2.50 | — |
| 6 | 37.87 | 19.70 | 7.97 | 16.33 | 15.63 | 2.50 | — |
| 7 | 30.27 | 21.57 | 8.69 | 19.75 | 17.22 | 2.50 | — |
| 8 | 34.56 | 23.01 | 7.97 | 16.33 | 15.63 | 2.50 | — |
| 9 | 37.85 | 20.45 | 6.62 | 12.33 | 15.25 | 7.50 | — |

TABLE I-continued

| Alloy # | Nb | Ti | Hf | Cr | Si | Al | Other |
|---|---|---|---|---|---|---|---|
| 10 | 36.85 | 19.45 | 6.62 | 11.33 | 13.25 | 12.50 | — |
| 11 | 36.85 | 20.45 | 6.62 | 13.33 | 17.25 | 2.50 | 3B |
| 12 | 34.85 | 19.45 | 6.62 | 13.33 | 17.25 | 2.50 | 6B |
| 13 | 38.85 | 21.45 | 6.62 | 13.33 | 15.25 | 2.50 | 2Ge |
| 14 | 38.85 | 21.45 | 6.62 | 13.33 | 13.25 | 2.50 | 4Ge |
| 15 | 34.85 | 19.45 | 6.62 | 13.33 | 17.25 | 2.50 | 6Ta |
| 16 | 34.85 | 19.45 | 6.62 | 13.33 | 17.25 | 2.50 | 6W |
| 17 | 34.85 | 19.45 | 6.62 | 13.33 | 17.25 | 2.50 | 6Mo |
| 18 | 34.85 | 19.45 | 6.62 | 13.33 | 17.25 | 2.50 | 6V |
| 19 | 34.85 | 19.45 | 6.62 | 13.33 | 17.25 | 2.50 | 6Zr |
| 20 | 20 | 43.35 | 17.40 | 6.17 | 13.33 | 17.25 | 2.50 |

The volume fractions of the niobium-based metallic the chromium-based Laves-type phase ($Cr_2M$) and the silicide phase ($M_5Si_3$) present in ingots cast of each of the alloys were predicted to be as follows in Table II. Also indicated are the predicted niobium, titanium and hafnium content in the silicide phase.

TABLE II

| Alloy # | Volume % Metallic | Volume % $Cr_2M$ | Volume % $M_5Si_3$ | Nb—Ti—Hf in $M_5Si_3$ |
|---|---|---|---|---|
| 1 | 31 | 27 | 42 | 31,21,10 |
| 2 | 37 | 21 | 42 | 31,21,10 |
| 3 | 37 | 18 | 45 | 31,21,10 |
| 4 | 37 | 24 | 39 | 31,21,10 |
| 5 | 25 | 33 | 42 | 30.5,18.5,13.5 |
| 6 | 37 | 24 | 39 | 30.5,18.5,13.5 |
| 7 | 25 | 33 | 42 | 22,27,13.5 |
| 8 | 37 | 24 | 39 | 22,27,13.5 |
| 9 | 37 | 18 | 45 | 30,20,10 |
| 10 | 37 | 18 | 45 | 29,19,10 |
| 11 | 37 | 18 | 45 | 29,20,10 |
| 12 | 37 | 18 | 45 | 27,19,10 |
| 13 | 37 | 18 | 45 | 31,21,10 |
| 14 | 37 | 18 | 45 | 31,21,10 |
| 15 | 37 | 18 | 45 | 31,21,10 |
| 16 | 37 | 18 | 45 | 31,21,10 |
| 17 | 37 | 18 | 45 | 31,21,10 |
| 18 | 37 | 18 | 45 | 31,21,10 |
| 19 | 37 | 18 | 45 | 31,21,10 |
| 20 | 37 | 18 | 45 | 41,12,9 |

Each of the above composites was produced by arc melting and casting in a water-cooled copper mold. Pins were machined from the resulting ingots by electrical discharge machining, similar to that described previously for the original composite. These pins were also then exposed isothermally at about 1200 C., with periodic removal from the furnace for observation and measurement of weight change as a result of oxidation.

The results of these tests are portrayed in FIGS. 3 through 12, which compare the oxidation resistance of pins formed from Alloys 1 through 20 at 1200 C. to the results from FIG. 1 for the pins formed of the low-chromium "baseline" NbTiHfCrAISi composite (i.e., without a silicon-modified Laves-type phase) and the high-chromium "baseline+Cr" NbTiHfCrAISi composite (i.e., with the silicon-modified Laves-type phase).

Figure 3:
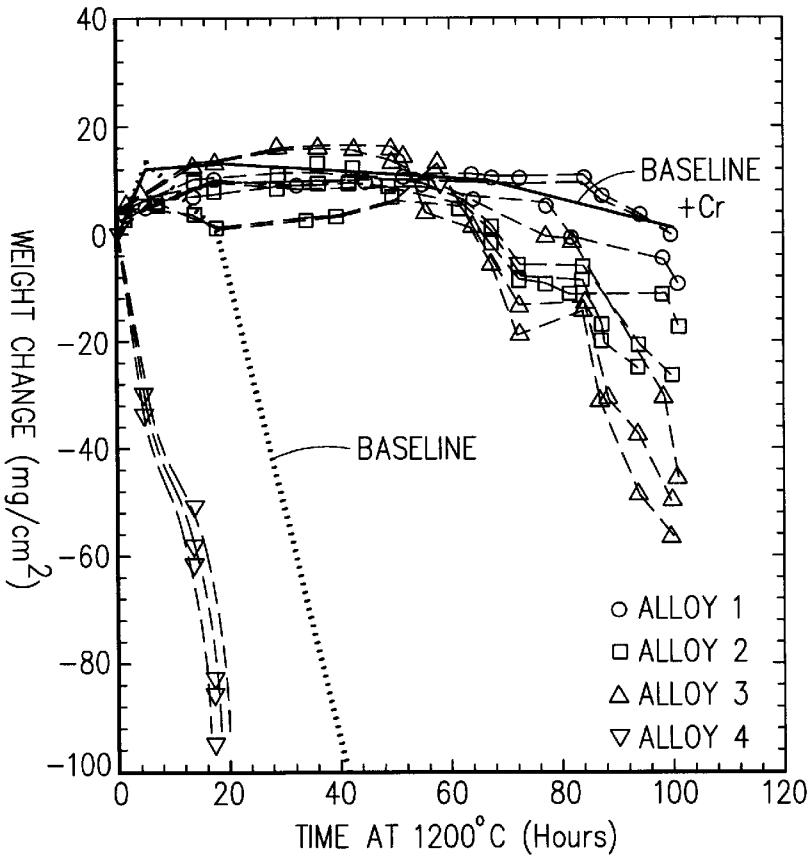

FIG. 3 shows that Alloy I with the lowest metal phase content of Alloys 1–4 resulted in lower oxidation losses. For a 37 volume percent metal phase content, there appeared to be an optimum in the proportion of Laves-type to silicide phases of about 1:2 (Alloy 2).

Figure 4:
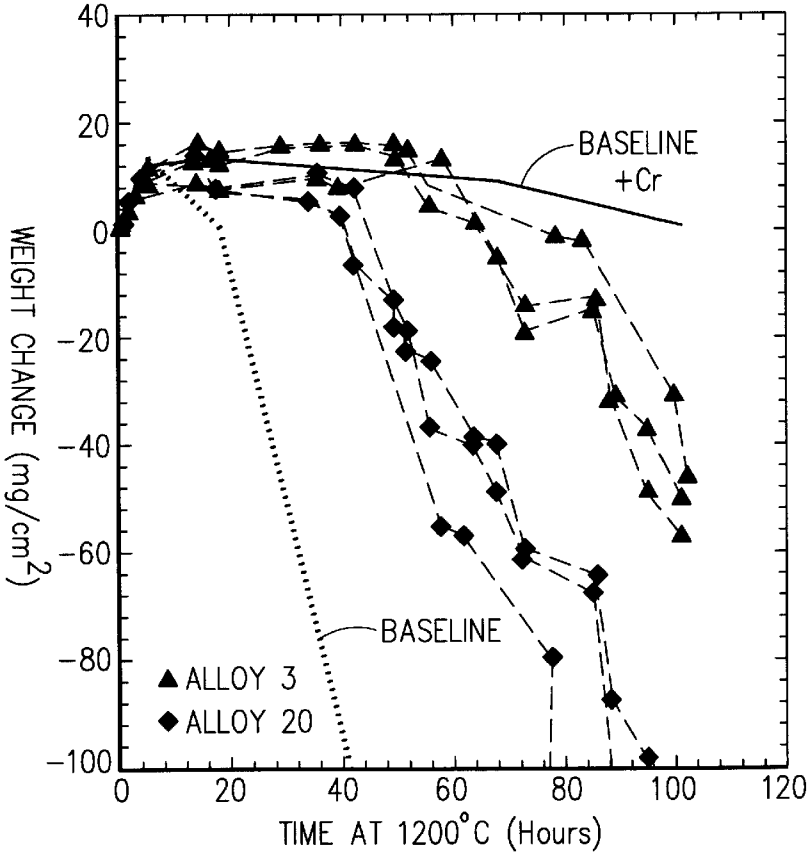
Figure 6:
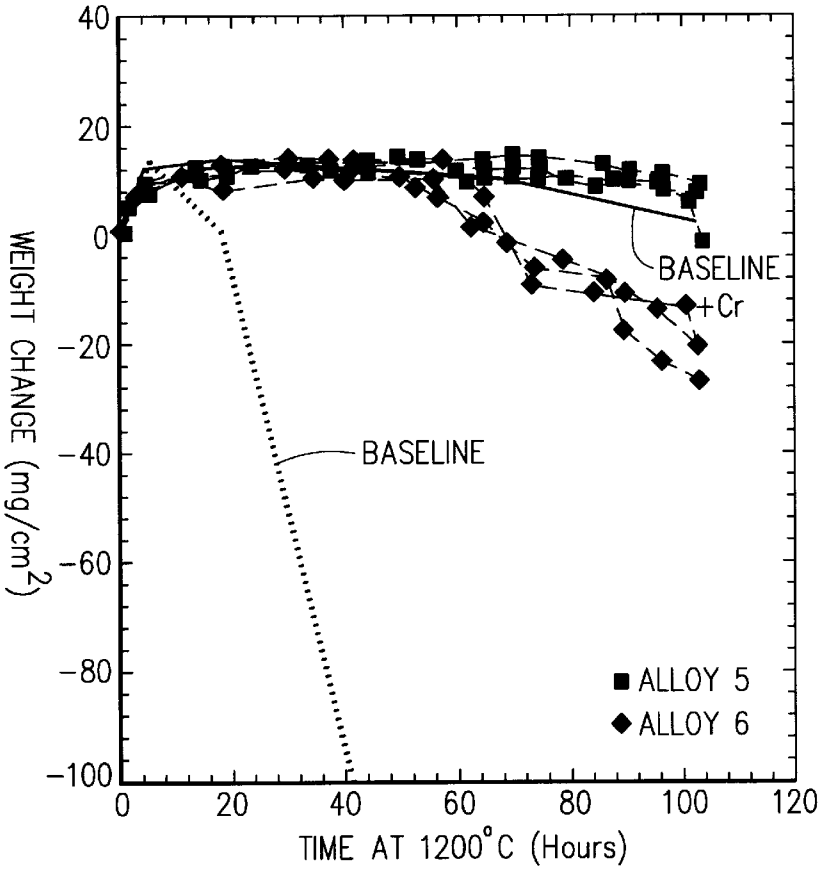
Figure 5:
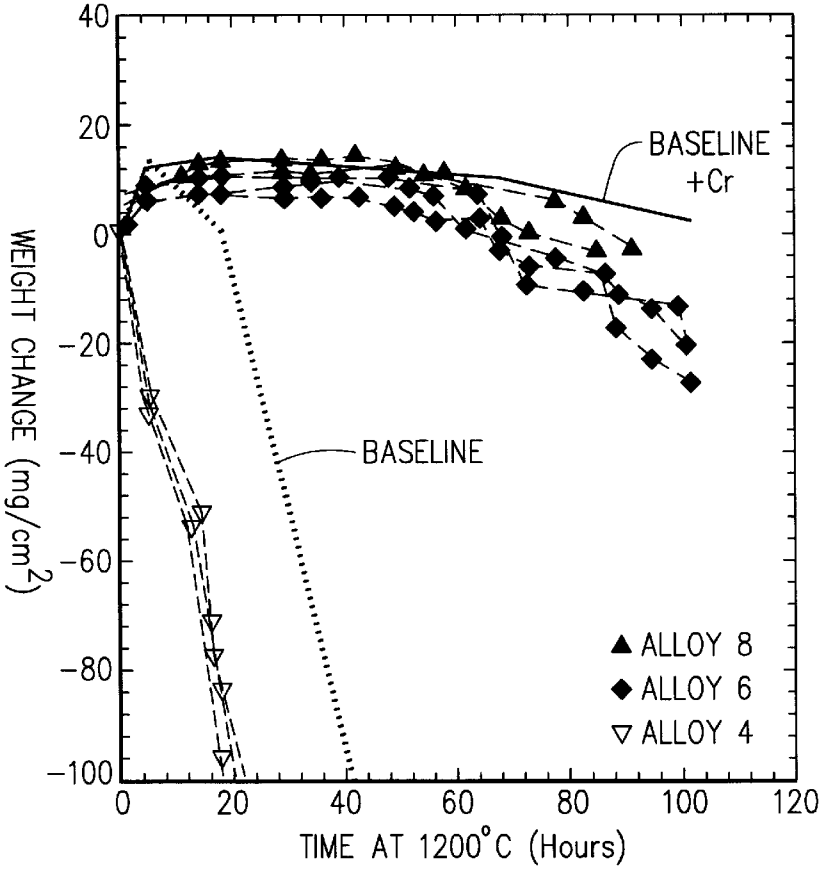
Figure 8:
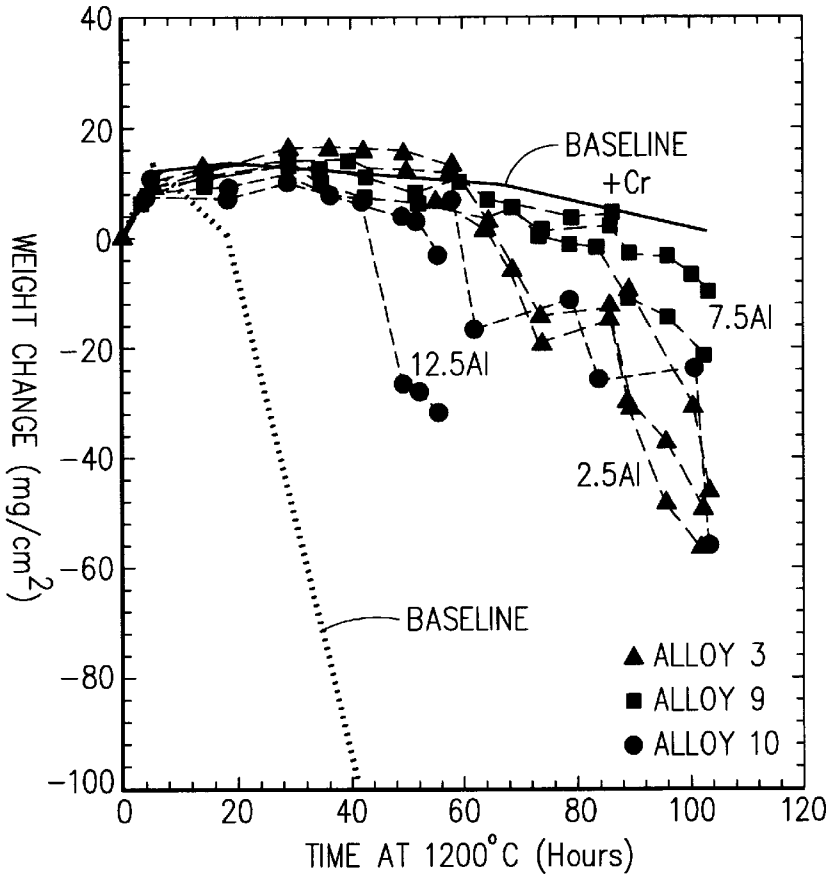
Figure 7:
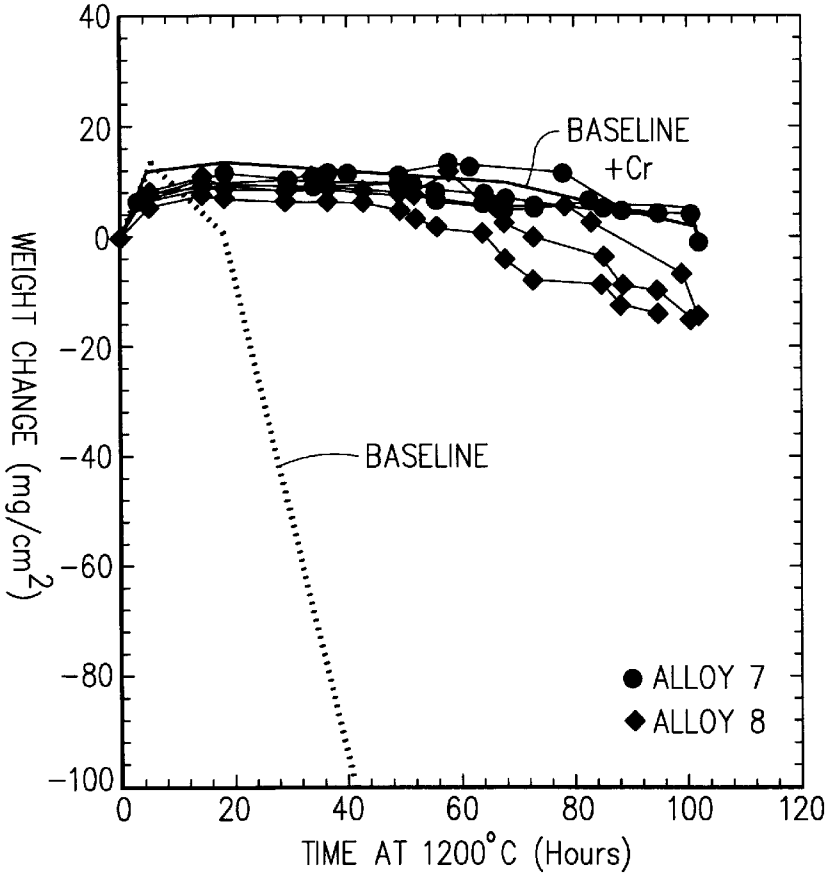

FIG. 4 indicates that a greater nominal titanium content (Alloy 3 vs. Alloy 20; 21 vs. 12 atomic percent) in the silicide phase improved oxidation resistance. FIG. 5 shows the influence of both titanium and hafnium in the nominal silicide (Alloys 6 and 8), while FIG. 6 shows that better oxidation resistance was obtained with lower metal volume fraction (Alloy 5 vs. Alloy 6), similar to that shown by FIG. 3. FIG. 7 shows the same effect as FIG. 6 for a different nominal silicide (Alloy 7 vs. Alloy 8). FIG. 8 indicates that substitution of aluminum for silicon, chromium, niobium and titanium (Alloys 3, 9 and 10) improved oxidation resistance, but at some point between about 7.5 (Alloy 9) and about 12.5 (Alloy 10) atomic percent aluminum, oxidation resistance was reduced.

Figure 10:
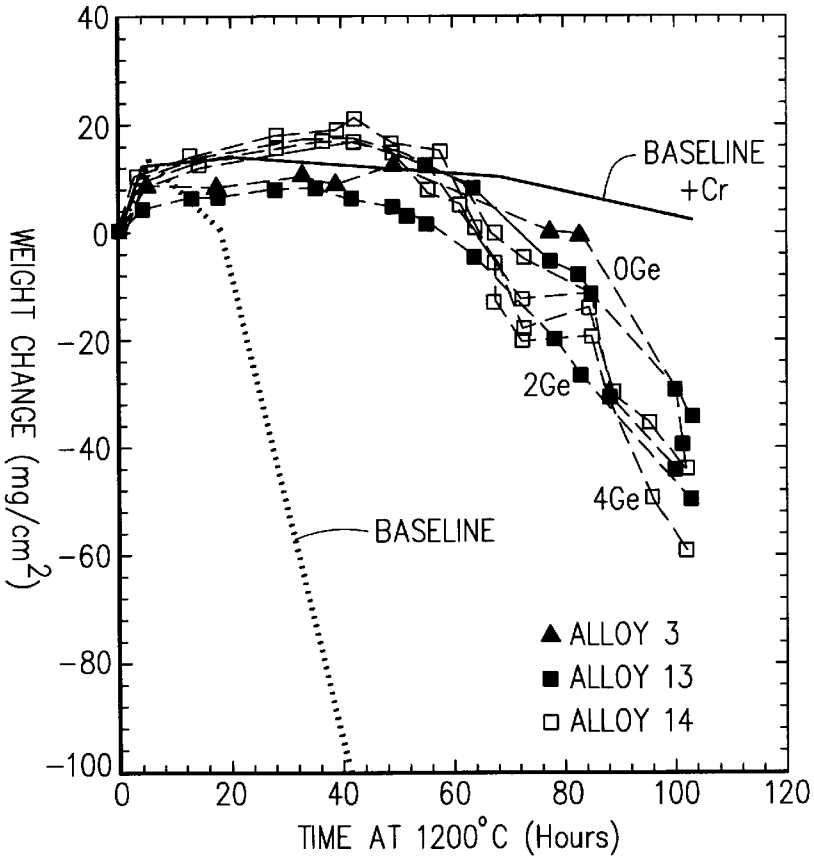
Figure 9:
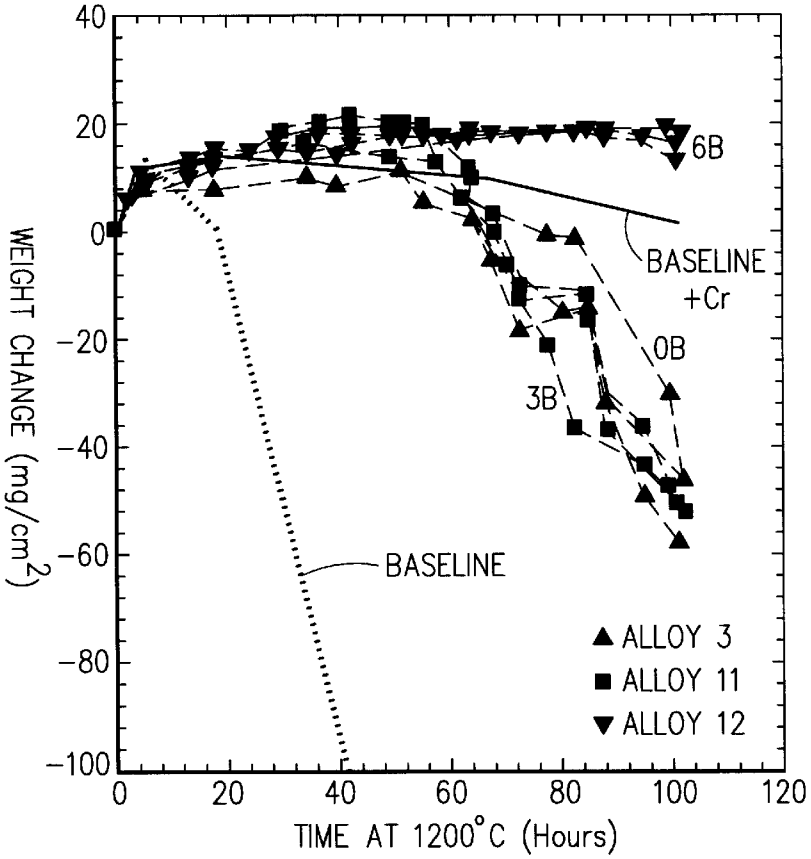
Figure 12:
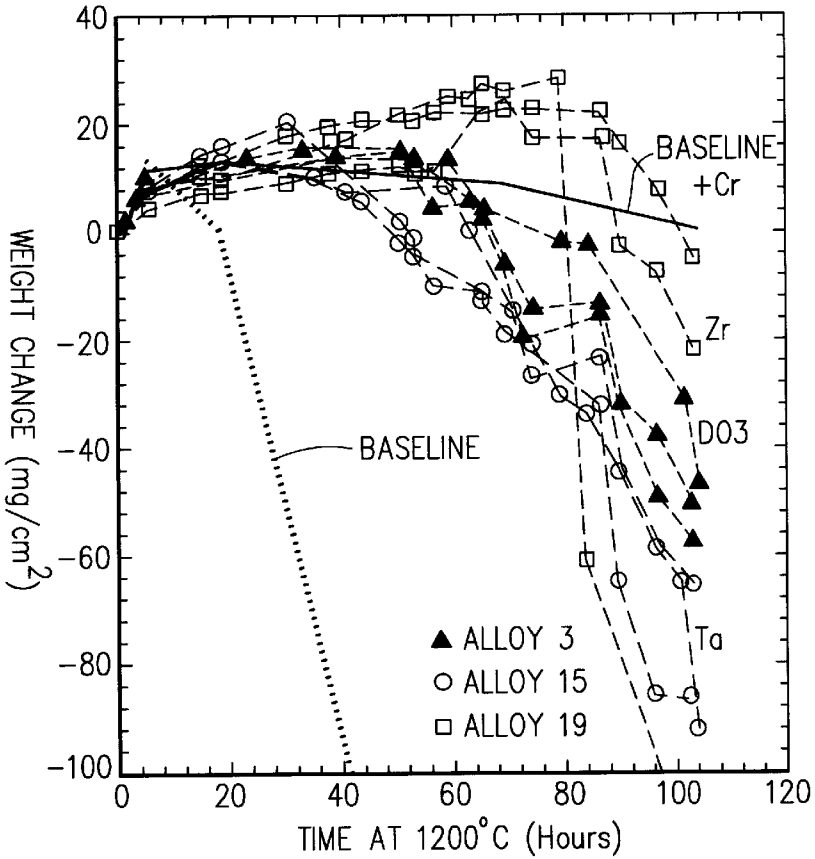
Figure 11:
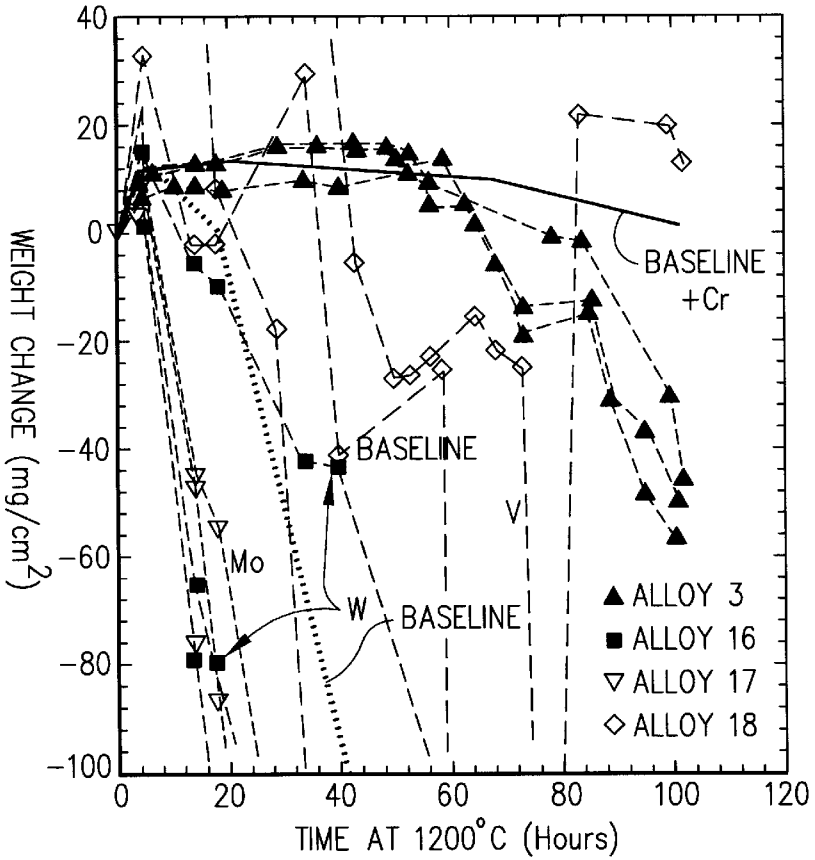

FIG. 9 indicates that oxidation resistance was not substantially affected with the addition of about 3 atomic percent boron (Alloy 11), but was notably improved with the addition of about 6 atomic percent boron (Alloy 12). FIG. 10 indicates that additions of germanium (Alloys 13 and 14) had no particular effect on oxidation resistance, at least for the tested alloys which form complex oxide mixtures rather than silica scale. FIGS. 11 and 12 show that additions of tungsten (Alloy 16), molybdenum (Alloy 17) and vanadium (Alloy 18) had a negative effect on oxidation resistance relative to the "baseline+Cr" alloy tested, while strengthening additions of tantalum (Alloy 15) and zirconium (Alloy 19) had a lesser negative effect.

On the basis of these tests, it was concluded that nominal aluminum and boron levels of about 7 and 5 atomic percent, respectively, were beneficial. Nominal chromium and silicon levels of about 13 and 15 atomic percent, respectively, were viewed as suitable. A hafnium content of about 8 atomic percent was considered to be preferred, as was relatively high titanium contents of about 20 atomic percent. A suitable range for tantalum, tungsten, molybdenum, vanadium and zirconium, alone or in any combination, was concluded to be about 3 to about 9 atomic percent. Suitable volume fractions of the phases were concluded to be about 30 to 50 volume percent of the silicide intermetallic, about 30 to 50 volume percent of the niobium-based metallic phase, and up to about 33 volume percent of the silicon-modified Laves-type phase. On the basis of the above, a chemistry, in atomic percent, is about 31.0% niobium, about 20.6% titanium, about 8.2% hafnium, about 15.0% silicon, about 13.2% chromium, about 7.0% aluminum, and about 5.0% boron.

While the invention has been described in terms of to an embodiment, it is apparent that other forms could be adopted by one skilled in the art. Therefore, the scope of the invention is to be limited only by the following claims.

What is claimed is:

1. An oxidation-resistant silicide-based composite containing a silicide intermetallic phase, a niobium-based metallic phase and a silicon-modified Laves phase, the silicide intermetallic phase being $M_5Si_3$ or $M_3Si$ where M is Nb+Ti+Hf, the silicon-modified Laves phase being $Cr_2M$ where M is Nb+Ti+Hf, the silicide-based composite containing greater than 25 volume percent of the niobium-based metallic phase, the balance being the silicide intermetallic phase and the silicon-modified Laves phase, wherein the silicide-based composite comprises, in atomic percent, about 30 to about 44% niobium, about 17 to about 23% titanium, about 6 to about 9% hafnium, about 11 to about 20% chromium, about 2 to about 13% aluminum and about 13 to about 18% silicon.

2. A silicide-based composite as recited in claim 1, wherein the silicide-based composite contains about 30 to about 50 volume percent of the silicide intermetallic phase, greater than 25 volume percent up to about 50 volume percent of the niobium-based metallic phase, and up to about 33 volume percent of the silicon-modified Laves phase.

3. A silicide-based composite as recited in claim 1, wherein the silicide-based composite further contains at least one element chosen from the group consisting of boron, germanium, tantalum, tungsten, molybdenum, vanadium and zirconium.

4. A silicide-based composite as recited in claim 1, wherein the silicide intermetallic phase contains, in atomic percent, about 22 to about 41% niobium, about 12 to about 21% titanium, and about 9 to about 13.5% hafnium.

5. A silicide-based composite as recited in claim 1, wherein the silicide-based composite contains about 3 to about 6 atomic percent boron.

6. A silicide-based composite as recited in claim 1, wherein the silicide-based composite contains about 2 to about 4 atomic percent germanium.

7. A silicide-based composite as recited in claim 1, wherein the silicide-based composite contains about 3 to about 9 atomic percent tantalum.

8. A silicide-based composite as recited in claim 1, wherein the silicide-based composite contains about 3 to about 9 atomic percent tungsten.

9. A silicide-based composite as recited in claim 1, wherein the silicide-based composite contains about 3 to about 9 atomic percent molybdenum.

10. A silicide-based composite as recited in claim 1, wherein the silicide-based composite contains about 3 to about 9 atomic percent vanadium.

11. A silicide-based composite as recited in claim 1, wherein the silicide-based composite contains about 3 to about 9 atomic percent zirconium.

12. An oxidation-resistant silicide-based composite containing a silicide intermetallic phase, a niobium-based metallic phase and a silicon-modified Laves phase, the silicide intermetallic phase being $M_5Si_3$ or $M_3Si$ where M is Nb+Ti+Hf, the silicon-modified Laves phase being $Cr_2M$ where M is Nb+Ti+Hf, the silicide-based composite containing at least 30 volume percent of the niobium-based metallic phase, the balance being the silicide intermetallic phase and the silicon-modified Laves phase, wherein the silicide-based composite comprises, in atomic percent, about 34 to about 44% niobium, about 17 to about 23% titanium, about 6 to about 8% hafnium, about 11 to about 18% chromium, about 2 to about 13% aluminum and about 13 to about 18% silicon.

13. A silicide-based composite as recited in claim 12, wherein the silicide-based composite contains about 30 to about 50 volume percent of the silicide intermetallic phase, about 30 to about 50 volume percent of the niobium-based metallic phase, and up to about 33 volume percent of the silicon-modified Laves phase.

14. A silicide-based composite as recited in claim 12, wherein the silicide-based composite further contains at least one element chosen from the group consisting of boron, germanium, tantalum, tungsten, molybdenum, vanadium and zirconium.

15. A silicide-based composite as recited in claim 12, wherein the silicide intermetallic phase contains, in atomic percent, about 22 to about 41% niobium, about 12 to about 21% titanium, and about 9 to about 13.5% hafnium.

16. A silicide-based composite as recited in claim 1, wherein the silicide-based composite contains an additional alloying element chosen from the group consisting of about 3 to about 6 atomic percent boron, about 2 to about 4 atomic percent germanium, about 3 to about 9 atomic percent tantalum, about 3 to about 9 atomic percent tungsten, about 3 to about 9 atomic percent molybdenum, about 3 to about 9 atomic percent vanadium, and about 3 to about 9 atomic percent zirconium.

17. A silicide-based composite as recited in claim 1, wherein the silicide-based composite comprises, in atomic percent, about 38.9% niobium, about 21.5% titanium, about 6.6% hafnium, about 13.3% chromium, about 2.5% aluminum and about 17.3% silicon.

18. A silicide-based composite as recited in claim 17, wherein the silicide-based composite contains, in atomic percent, about 31.0% niobium, about 20.6% titanium, about 8.2% hafnium, about 15.0% silicon, about 13.2% chromium, about 7.0% aluminum, and about 5.0% boron, and contains about 45 volume percent of the silicide intermetallic phase, about 37 volume percent of the niobium-based metallic phase, and about 18 volume percent of the silicon-modified Laves phase.

* * * * *

UNITED STATES PATENT AND TRADEMARK OFFICE

CERTIFICATE OF CORRECTION

PATENT NO. : 5,942,055

DATED : August 24, 1999

INVENTOR(S) : Melvin Robert Jackson and Bernard

It is certified that error appears in the above-identified patent and that said Letters Patent is hereby corrected as shown below:

Claim 18, line 1, please change claim 17 to claim 12.

Signed and Sealed this

Twenty-fifth Day of January, 2000

*Attest:*

*Attesting Officer*

*Acting Commissioner of Patents and Trademarks*